US005538011A

United States Patent [19]

Craft et al.

[11] Patent Number: 5,538,011

[45] Date of Patent: Jul. 23, 1996

[54] FOLDING CHAIR AID FOR SEXUAL RELATIONS

[76] Inventors: James Z. Craft, 1200 2nd Pl., Longwood, Fla. 32750; James Z. Craft, Jr., 137 Lake Ada Dr., Sanford, Fla. 32773; Leonard Simpson, 1200 Second Pl., Longwood, Fla. 32750

[21] Appl. No.: 372,333

[22] Filed: Jan. 13, 1995

[51] Int. Cl.[6] ..... A61G 15/00; A47C 4/00

[52] U.S. Cl. ..... 128/845; 297/25

[58] Field of Search ..... 128/845, 846; 297/22, 25, 46, 47, 48, 410; 5/602

[56] References Cited

U.S. PATENT DOCUMENTS

| | | | |
|---|---|---|---|
| 247,208 | 9/1881 | Miller | 297/410 |
| 2,104,830 | 1/1938 | Collard | 297/22 |
| 2,913,732 | 6/1958 | Jones . | |
| 3,929,373 | 12/1975 | Gawlinski | 297/25 |
| 3,971,592 | 7/1976 | Farley . | |
| 4,084,849 | 4/1978 | Ishida | 297/22 |
| 4,180,062 | 12/1979 | Alberti | 5/602 |
| 4,247,091 | 1/1981 | Glowacki | 5/602 |
| 4,825,855 | 3/1988 | Kundson . | |
| 5,294,176 | 3/1994 | Asinovsky . | |

*Primary Examiner*—Michael A. Brown
*Attorney, Agent, or Firm*—Paul S. Rooy

[57] ABSTRACT

A chair aid comprising a pair of back beams and a pair of soar supports rotatably attached to a pair of seat beams, a seat with a seat cutout attached to the pair of seat beams and a back attached to the pair of back beams. A pair of leg supports is slidably and rotatably attached to the seat. A head rest is slidably attached to the back. The angle between the pair of seat beams and the pair of seat supports may be fixed by means of leg straps attached the pair of seat beams and the pair of seat supports, the length of the leg straps being variable by means of leg strap holes and leg strap buckles. The angle between the pair of back beams and the pair of seat beams may be fixed by means of a pair of back supports rotatably attached to the pair of seat beams, a dowel attached to the pair of back supports, and at least one notch board comprising notches attached to the seat, the notches being sized to frictionally admit the dowel.

10 Claims, 4 Drawing Sheets

FOLDING CHAIR AID FOR SEXUAL RELATIONS

FIELD OF THE INVENTION

This invention relates to sexual relations aids, and in particular to a folding chair to aid in sexual relations.

BACKGROUND OF THE INVENTION

The benefits of sexual relations have been long recognized by medical authorities, and include strengthening of the circulatory system (including the heart) and reduced blood pressure. Standard residential furniture (with the exception of beds) is usually not designed to be used in intercourse. This creates a problem in that the variety of furniture which may be used during conjugal relations is limited, and also creates a problem where one partner's ability to move is limited due to medical reasons. In this later case, little if any furniture is available to be used by individuals suffering from medical conditions which renders it difficult or impossible to engage in sexual relations in conventional ways.

EXISTING DESIGNS

A number of patents have issued for chairs or seats to be used in the aid of sexual intercourse. Asinovsky was granted U.S. Pat. No. 5,294,176 for a Sexual Device for Handicapped Men, which provided a seat for the incapacitated man's partner to sit on, and means for the handicapped man to impart motion to the seat. Although the device appeased fictional, no provision was made for neck support, nor means to adjust the angle of the back support, seat, nor the leg rests. In addition, the disclosure did not teach the possibility of folding the invention, thereby rendering storage and transportation difficult.

U.S. Pat. No. 3,971,592 was granted Farley for a Chair for Aiding Conjugal Relations for the Infirm. This invention was capable of folding, but its back could only be adjusted to two positions ("horizontal" and "vertical"), and no leg supports nor a neck support was taught. Also, no provision to adjust the angle of the seat was disclosed.

Kundson received U.S. Pat. No. 4,825,855 for an Intercourse Aiding Apparatus, which comprised a fabric hanging chair with a cutout in the seat. It was envisioned that this device would hang from a hook in the ceiling. While it is theoretically possible to mount a hook securely into an overhead ceiling beam, from which to suspend this Apparatus, the process is fraught with danger: what if the hook is securely attached to the beam, but the beam is insufficiently strong to support the weight of an individual disposed within the apparatus? What the hook pulls out of the beam while the Apparatus is occupied? And what if the hook is erroneously mounted in commonly used ceiling stone wall, and not in a structural beam and pulls free while the seat in in use? In all these circumstances, it is possible that the individual occupying the Apparatus could fall onto the other individual engaged in intercourse, thereby causing injury to one or both participants.

Finally, a problem associated with all three of the above inventions is their lack of discretion: it is fairly obvious what the purpose of their design is to facilitate sexual intercourse. Therefore, these inventions must be folded up (if possible) and put away, out of the sight of inquisitive, and perhaps young, eyes, in order to avoid potentially embarrassing questions. And once stored, these devices must be removed from storage and re-assembled or re-hung, as appropriate, prior to subsequent use. These chores add substantially to the work associated with using the above mentioned designs, and in the case of medically disabled or handicapped individuals, may render their use difficult.

SUMMARY OF THE INVENTION

Accordingly, it is an object of the present invention to provide a chair aid whose back is capable of angular adjustment. Design features allowing this object to be accomplished include a left seat beam rotatably attached to a left back support and a left back beam, and a fight seat beam rotatably attached to a fight back support and a fight back beam, and a dowel attached to the left and right back supports fictionally engaged with notches in at least one notch board. Advantages associated with the accomplishment of this object include enhanced ease and versatility of use.

It is another object of the present invention to provide a chair aid whose seat is capable of vertical adjustment. Design features allowing this object to be accomplished include a left seat beam rotatably connected to a left seat support, a tight seat beam rotatably connected to a fight seat support, and straps comprising strap buckles and strap holes limiting the angle between the seat beams and the seat supports. Benefits associated with the accomplishment of this object include enhanced ease and versatility of use.

It is another object of this invention to provide a chair aid having leg supports which pivot relative to a seat. Design features enabling the accomplishment of this object include seat U-brackets attached to the seat, and leg beams disposed within the seat U-brackets. Advantages associated with the realization of this object include enhanced case and versatility of use.

It is still another object of this invention to provide a chair aid having an adjustable height head rest. Design features allowing this object to be achieved include a head support having a head rest attached to a head support beam, a slot in the head support beam, and butterfly bolts attaching the head support to a seat back through the slot. A benefit associated with reaching this objective is increased comfort during use.

It is a further object of this invention to provide a chair aid which is capable of being folded. Features permitting this object to be accomplished include a pair of back supports rotatably attached to a pair of seat beams, a pair of seat supports rotatably attached to the pair of seat beams, and a pair of back beams rotatably attached to the pair of seat beams. Benefits associated with the achievement of this object include ease of storage and simple re-assembly.

It is still another object of this invention to provide a chair aid having easily removable leg supports. Design features allowing this object to be achieved include a pair of seat U-brackets attached to a seat, and a leg beam disposed loosely in each seat U-bracket. A benefit associated with reaching this objective is that when the leg supports are removed, it is less obvious that the chair is designed as a sex aid, and may be left out between uses, with less attendant possibility of embarrassment.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIG. 1. Sheet two contains FIG. 2. Sheet three contains FIGS. 3 and 4. Sheet four contains FIGS. 5 and 6.

DETAILED DESCRIPTION OF THE PREFERRED EMBODIMENT

Figure 1:
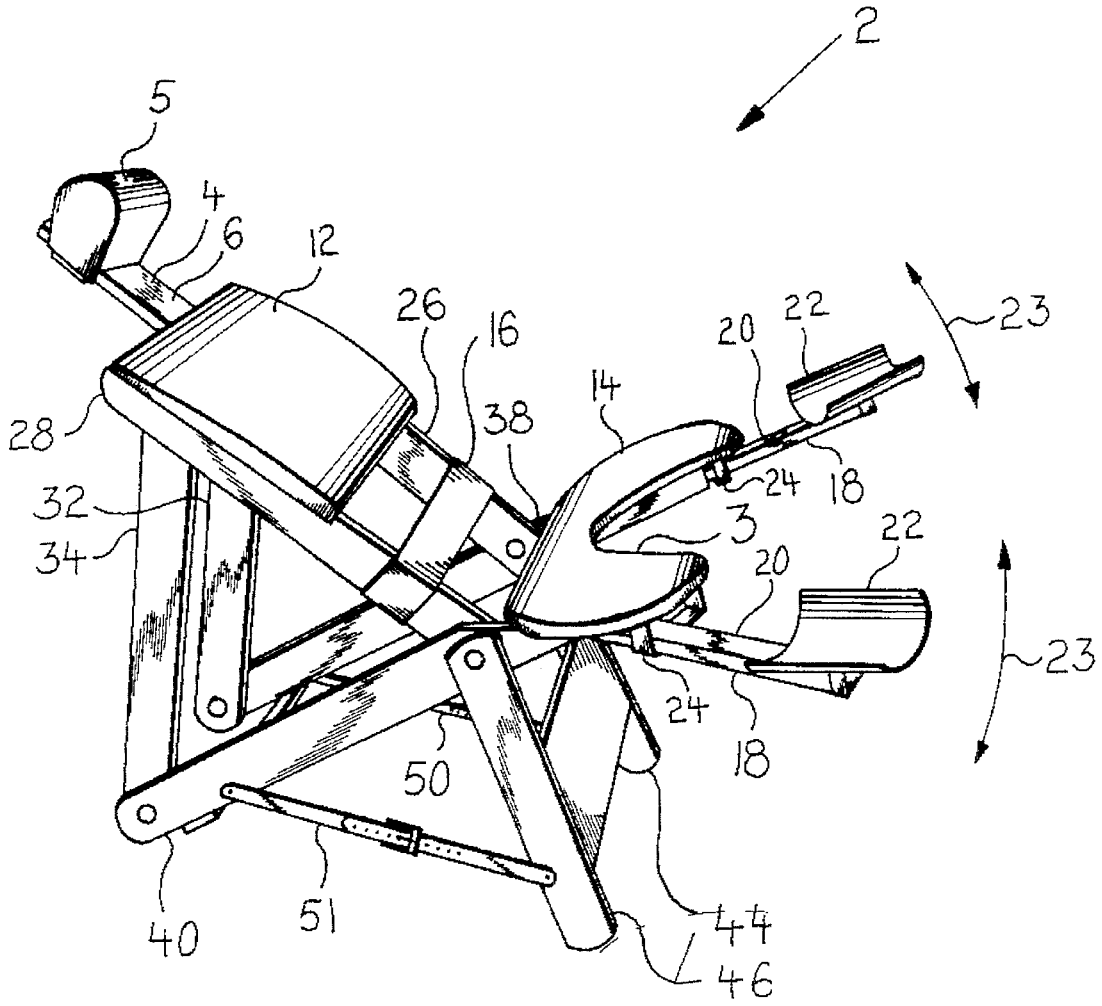
FIG. 1 is a side isometric view of a chair aid.

FIG. 1 is a side isometric view of a chair aid. Mutually parallel left seat beam 38 and tight seat beam 40 are rigidly attached to seat 14. Seat 14 incorporates seat cutout 3 disposed between left seat beam 38 and fight seat beam 40. Left back beam 26 and left seat support 44 are rotatably attached to left seat beam 38 at the extreme of left seat beam 38 to which seat 14 is attached. Right back beam 28 and fight seat support 46 are rotatably attached to the extreme of fight seat beam 40 to which seat 14 is attached.

One extreme of left leg strap 50 is attached to left seat beam 38; another extreme of left leg swap 50 is attached to left seat support 44. One extreme of fight leg strap 51 is attached to fight seat beam 40; another extreme of fight leg strap 51 is attached to fight seat support 46. As may be observed in FIG. 2, left leg strap 50 and fight leg strap 51 incorporate leg strap holes 52 and buckles 54, whereby the length of left leg strap 50 and fight leg strap 51 may be varied, thereby varying the slope angle and height of seat 14, as desired by the chair aid 2 occupant. Back 12 is rigidly attached to left back beam 26 and fight back beam 28. Notch boards 31 incorporating notches 30 are attached to back 12 between left back beam 26 and fight back beam 28. One extreme of back strap 16 is attached to left back beam 26 between back 12 and the point at which left back beam 26 is rotatably attached to left seat beam 38; the other extreme of back strap 16 is attached to fight back beam 28 between back 12 and the point at which right back beam 28 is rotatably attached to fight seat beam 40.

Figure 2:
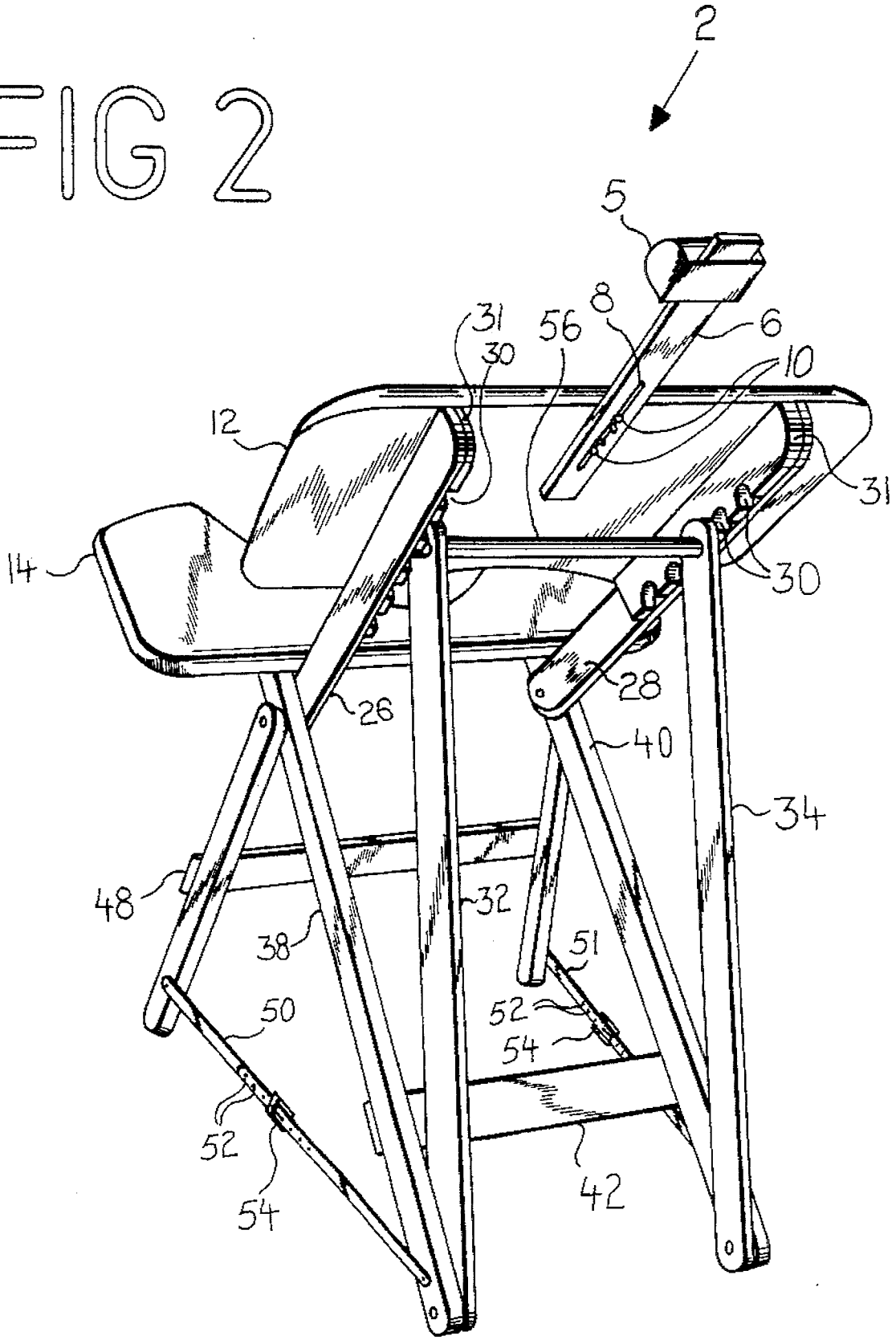
FIG. 2 is a rear quarter isometric view of a chair aid.

Referring now also to FIG. 2, one extreme of left back support 32 is rigidly attached to dowel 56; an opposite extreme of left back support 32 is rotatably attached to an extreme of left seat beam 38 opposite seat 14. One extreme of right back support 34 is rigidly attached to dowel 56; an opposite extreme of right back support 34 is rotatably attached to an extreme of right seat beam 40 opposite seat 14. Dowel 56 is engaged in notches 30, thereby determining the slope angle of back 12.

From horizontal member 48 is rigidly attached to left seat support 44 and right seat support 46, and serves as reinforcement. Rear horizontal member 42 is rigidly attached to left seat beam 38 and fight seat beam 40, and serves as reinforcement.

Figure 5:
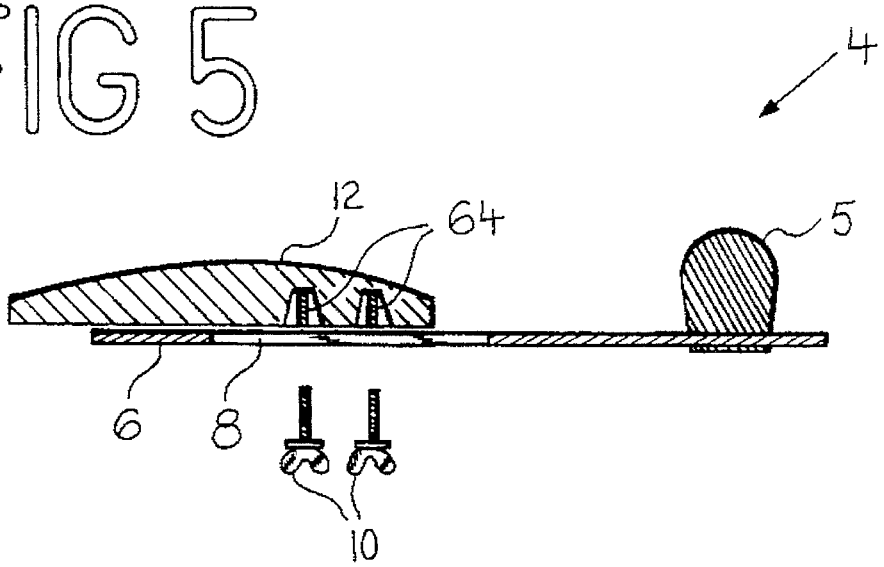
FIG. 5 is a side cross-sectional view of a head support attached to a seat back.

Referring to FIGS. 2 and 5, head support 4 is comprised of head rest 5 attached to head support beam 6 having head support beam slot 8. Back 12 incorporates back female threaded holes 64. Head support 4 is slidably attached to back 12 by means of head support beam butterfly bolts 10 sized to mate with back female threaded holes 64. In use, head support beam butterfly bolts 10 are loosened, head rest 5 is located at the desired height, and head support beam butterfly bolts 10 are tightened, thereby fixing head rest 5 at the desired distance from back 12.

Figure 6:
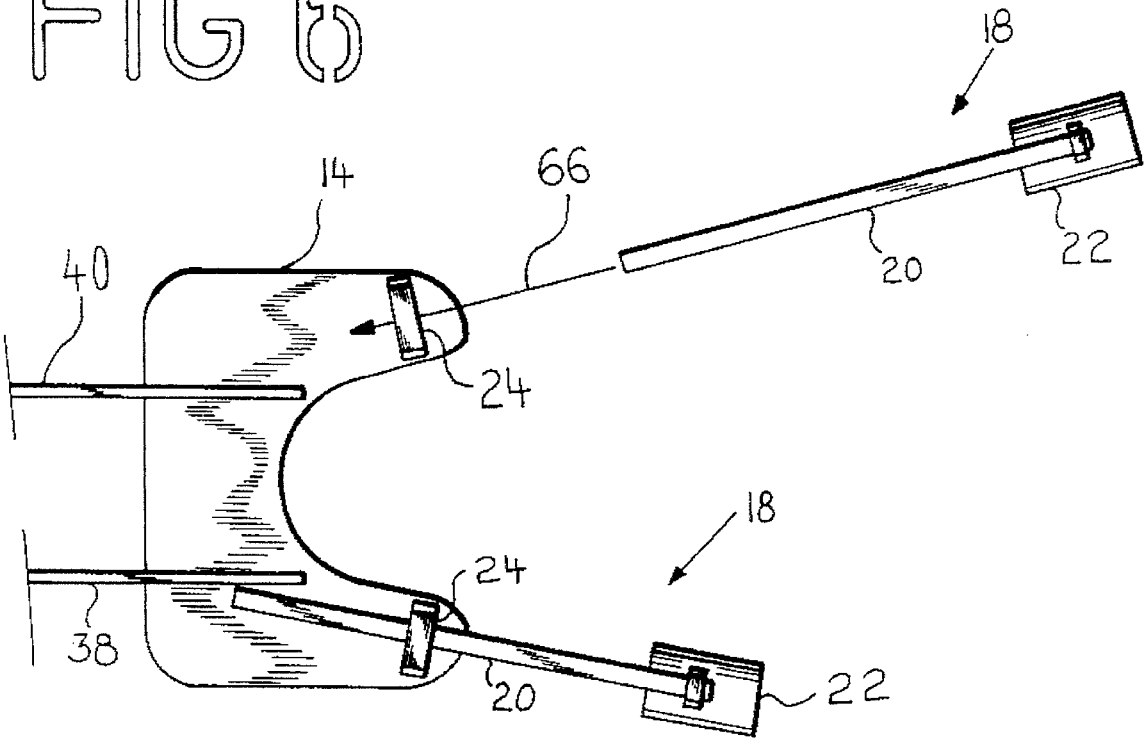
FIG. 6 is a bottom view of a seat showing the method of attachment of the leg supports.

FIG. 6 is a bottom view of seat 14 showing the method of attachment of leg supports 18. Each leg support 18 comprises a leg rest 22 attached to a leg beam 20. Seat U-brackets 24 are attached to the underside of seat 14. Each seat U-bracket 24 is sized to loosely admit a leg beam 20. Leg supports 18 are installed by sliding a leg beam 20 into a seat U-bracket 24 as indicated by arrow 66. Each leg beam 20 is free to slide horizontally within its respective seat U-bracket 24, thereby allowing the angle between leg supports 18 to be varied as indicated by arrows 23 in FIG. 1, as the comfort of the chair aid 2 occupant may dictate.

Figure 3:
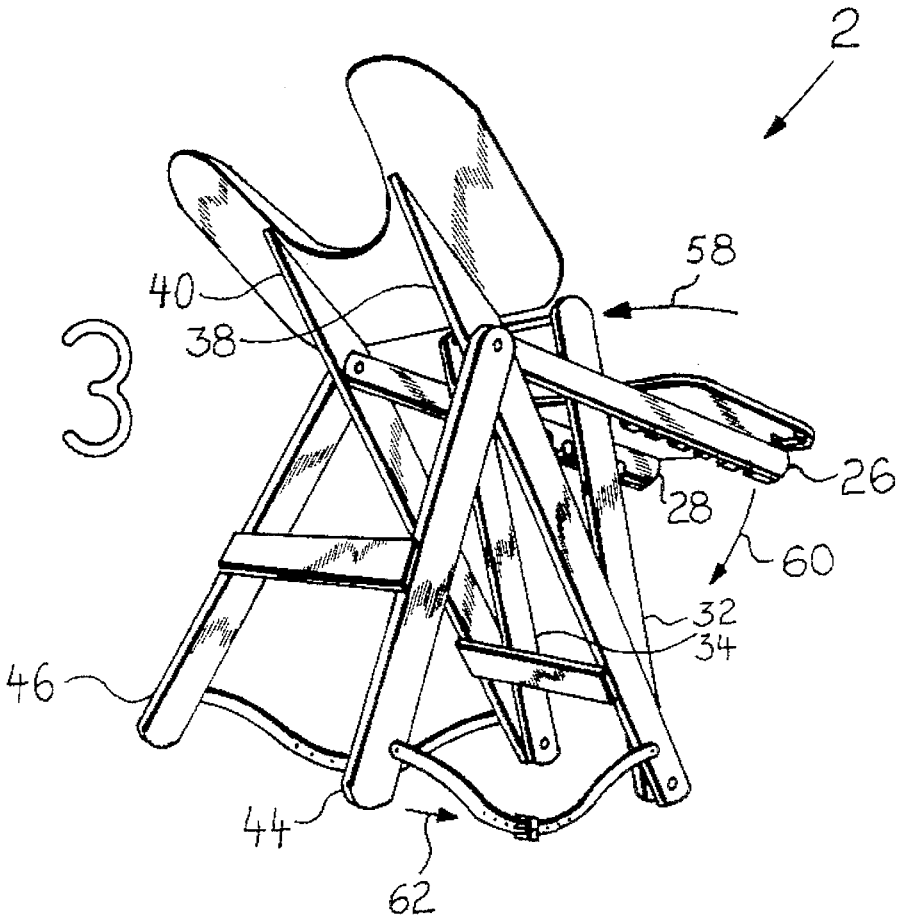
FIG. 3 is a rear quarter isometric view of a chair aid in the process of being folded.
Figure 4:
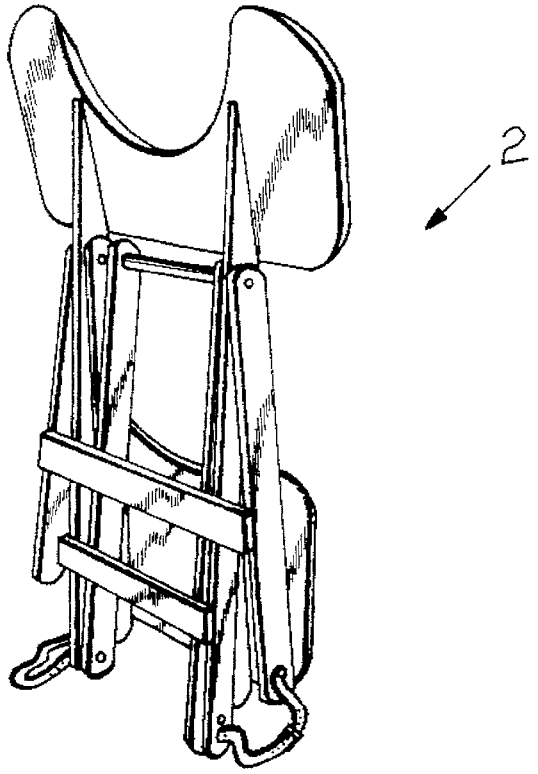
FIG. 4 is a front quarter isometric view of a chair aid in the folded position.

FIG. 3 is a rear quarter isometric view of chair aid 2 in the process of being folded. FIG. 4 is a rear quarter isometric view of chair aid 2 in the folded position. Chair aid 2 is folded as follows: leg supports 18 are removed from seat 14, left back support 32 and fight back support 34 are rotated toward left seat beam 38 and fight seat beam 40 respectively, as indicated by arrow 58; left back beam 26 and fight back beam 28 are rotated toward left seat beam 38 and fight seat beam 40 respectively, as indicated by arrow 60; and left seat support 44 and fight seat support 46 are rotated toward left seat beam 38 and fight seat beam 40 respectively, as indicated by arrow 62. FIG. 4 illustrates the folded position of chair aid 2.

In order to unfold chair aid 2 for use, the procedure to fold chair aid 2 is reversed. Leg supports 18 are installed as described above, and chair aid 2 ends up in the position depicted in FIGS. 1, ready for use.

Chair aid 2 may be manufactured of wood, plastic, synthetic material, or other appropriate is materials. All fasteners are standard, commercially available fasteners.

While a preferred embodiment of the invention has been illustrated herein, it is to be understood that changes and variations may be made by those skilled in the art without departing from the spirit of the appending claims.

DRAWING ITEM INDEX 2 chair aid
3 seat cutout
4 head support
5 head rest
6 head support beam
7 head support beam slot
8 head support beam butterfly bolt
12 back
14 seat
16 strap
18 leg support
20 leg beam
22 leg rest
23 arrow
24 seat U-bracket
26 left back beam
28 fight back beam
30 notch
31 notch board
32 left back support 34 right back support
38 left seat beam
40 right seat beam
42 rear horizontal member
44 left seat support
46 right seat support
48 from horizontal member
50 left leg strap
51 right leg strap
52 leg strap holes
54 buckle
56 dowel
58 arrow
60 arrow
62 arrow
64 back female threaded holes
66 arrow

We claim:

1. A chair aid comprising:

a left seat beam and a right seat beam attached to a seat, said seat comprising a seat cutout disposed between said left seat beam and said right seat beam;

a left back beam and a left seat support rotatably attached to said left seat beam;

a right back beam and a right seat support rotatably attached to said right seat beam;

a back attached to said left back beam and said right back beam;

a first means of fixing an angle between said left seat beam and said left seat support, and between said right seat beam and said right seat support;

a second means of fixing an angle between said left back beam and said left seat beam, and between said right back beam and said right seat beam; and a head support slidably attached to said seat, said head support comprising a head rest, and a third means of fixing a distance between said head rest and said seat.

2. The chain aid of claim 1 wherein said first means comprises:

a left leg strap attached to said left seat beam and said left seat support, said left leg strap comprising leg strap holes and a buckle, whereby the length of said left leg strap may be varied; and a right leg strap attached to said right seat beam and said right seat support, said right leg strap comprising leg strap holes and a buckle, whereby the length of said right leg strap may be varied.

3. The chair air of claim 1 wherein said second means comprises a left back support rotatably attached to said left seat beam;

a right back support rotatably attached to said right seat beam;

at least one notch board comprising notches attached to said back; and a dowel attached to said left back support and said right back support, said dowel being sized to frictionally fit into said notches.

4. The chair aid of claim 1 wherein said third means comprises a head support beam attached to said head rest, said head support beam having a head support beam slot, said head support being slidably attached to said back by means of at least one bolt through said head support beam slot whereby said at least one bolt may be loosened to allow said head support beam to translate relative to said back, and whereby said at least one bolt may be tightened to fix the distance between said head and said back.

5. A chair aid comprising:

a left seat beam and a right seat beam attached to a seat, said seat comprising a seat cutout disposed between said left seat beam and said right seat beam;

a left back beam and a left seat support rotatably attached to said left seat beam;

a right back beam and a right seat support rotatably attached to said right seat beam;

a back attached to said left back beam and said right back beam;

a first means of fixing an angle between said left seat beam and said left seat support, and between said right seat beam and said right seat support;

a second means of fixing an angle between said left back beam and said left seat beam, and between said right back beam and said right seat beam; and leg supports slidably and swivellably attached to said seat, said leg supports comprising leg rests, and a fourth means of slidably and swivellably attaching said leg supports to said seat, whereby said leg supports can move side to side laterally relative to said seat.

6. The chair aid of claim 5 wherein said fourth means comprises seat U-brackets attached to said seat, and a leg beam attached to each said leg rest, each said seat U-bracket being sized to loosely admit said one said leg beam, whereby said leg supports may slide and swivel laterally relative to said seat.

7. A chair aid comprising a pair of back beams and a pair of seat supports rotatably attached to a pair of sea beams; a seat comprising a seat cutout attached to said pair of seat beams; a back attached to said pair of back beams; a first means of fixing an angle between said pair of seat supports and said pair of seat beams; and a pair of leg supports slidably and swivellably attached to said seat, whereby said leg supports may slide and swivel side to side laterally relative to said seat.

8. The chair aid of claim 7 further comprising a head support slidably attached to said back.

9. The chair aid of claim 7 wherein said first means comprises leg straps attached to said pair of seat beams and said pair of seat supports, the length of said leg straps being variable by means of leg strap holes and leg strap buckles.

10. The chair aid of claim 7 wherein said second means comprises a pair of back supports rotatably attached to said pair of seat beams, a dowel attached to said pair of back supports, and at least one notch board comprising notches attached to said back, said notches being sized to frictionally admit said dowel.

* * * * *

UNITED STATES PATENT AND TRADEMARK OFFICE

CERTIFICATE OF CORRECTION

PATENT NO. : 5,538,011
DATED : July 23, 1996
INVENTOR(S) : James Z. Craft, et. al.

It is certified that error appears in the above-indentified patent and that said Letters Patent is hereby corrected as shown below:

Title Page - Abstract line 2 "soar" *should read* "seat"
Column 1 line 32 "appeased" *should read* "appeared"
Column 1 line 33 "fictional" *should read* "functional"
Column 1 line 53 "What the" *should read* "What if the"
Column 2 line 13 "fight" *should read* "right"
Column 2 line 14 "fight" (2 occurrences) *should read* "right" (2 occurrences)
Column 2 line 16 "fictionally" *should read* "frictionally"
Column 2 line 24 "tight ... fight" *should read* "right ... right"
Column 3 line 20 "tight" *should read* "right"
Column 3 line 25 "fight" *should read* "right"
Column 3 line 26 "fight" *should read* "right"
Column 3 line 29 "swap" *should read* "strap"
Column 3 line 30 "fight" *should read* "right"
Column 3 line 31 "fight" (2 occurrences) *should read* "right" (2 occurrences)
Column 3 line 32 "fight" *should read* "right"
Column 3 line 33 "fight" *should read* "right"
Column 3 line 35 "fight" *should read* "right"
Column 3 line 37 "Back 12 is rigidly" *should start a new paragraph.*
Column 3 line 38 "fight" *should read* "right"
Column 3 line 40 "fight" *should read* "right"
Column 3 line 44 "fight" *should read* "right"
Column 3 line 46 "fight" *should read* "right"
Column 3 line 56 "From" *should read* "Front"
Column 3 line 59 "fight" *should read* "right"
Column 4 line 20 "fight" *should read* "right"

UNITED STATES PATENT AND TRADEMARK OFFICE

CERTIFICATE OF CORRECTION

PATENT NO. : 5,538,011

DATED : July 23, 1996

INVENTOR(S) : James Z. Craft, et. al.

It is certified that error appears in the above-indentified patent and that said Letters Patent is hereby corrected as shown below:

| | |
|---|---|
| Column 4 line 21 | "fight" *should read* "right" |
| Column 4 line 22 | "fight" *should read* "right" |
| Column 4 line 23 | "fight" *should read* "right" |
| Column 4 line 25 | "fight" *should read* "right" |
| Column 4 line 26 | "fight" *should read* "right" |
| Column 4 line 34 | "appropriate is materials" *should read* "appropriate materials" |
| Column 4 line 50 | "7 head support ..." *should read* "8 head support..." |
| Column 4 line 51 | "8 head support beam ..." *should read* "10 head support beam ..." |
| Column 4 line 63 | "28 fight back beam" *should read* "28 right back beam" |
| Column 5 line 7 | "48 from horizontal member" *should read* "48 front horizontal member" |
| Column 5 line 42 | "chain" *should read* "chair" |
| Column 5 line 53 | "air" *should read* "aid" |
| Column 6 line 9 | "head and" *should read* "head rest and" |
| Column 6 line 42 | "sea" *should read* "seat" |
| Column 6 line 46 | "seat beams; and a pair" *should read* "seat beams; a second means of fixing an angle between said pair of back beams and said pair of seat beams; and a pair." |

Signed and Sealed this

Seventeenth Day of December, 1996

*Attest:*

Bruce Lehman

BRUCE LEHMAN

*Attesting Officer*

*Commissioner of Patents and Trademarks*